US005455555A

United States Patent [19]

Onabuta

[11] Patent Number: 5,455,555

[45] Date of Patent: Oct. 3, 1995

[54] CHIP VARISTOR

[75] Inventor: Shuichi Onabuta, Tokyo, Japan

[73] Assignee: TDK Corporation, Tokyo, Japan

[21] Appl. No.: 157,825

[22] Filed: Nov. 24, 1993

[30] Foreign Application Priority Data

Nov. 24, 1992 [JP] Japan ..... 4-313441
Nov. 24, 1992 [JP] Japan ..... 4-313442

[51] Int. Cl.[6] ..... H01C 7/10; H01C 1/14

[52] U.S. Cl. ..... 338/20; 338/21; 338/322; 338/326

[58] Field of Search ..... 338/21, 20, 322, 338/323, 326

[56] References Cited

U.S. PATENT DOCUMENTS

| | | | |
|---|---|---|---|
| 4,706,060 | 11/1987 | May | 338/20 |
| 4,785,276 | 11/1988 | May | 338/21 |
| 5,075,665 | 12/1991 | Taira et al. | 338/21 |

FOREIGN PATENT DOCUMENTS

| | | |
|---|---|---|
| 49-34692 | 3/1974 | Japan . |
| 57-42163 | 9/1982 | Japan . |
| 58-192745 | 11/1983 | Japan . |
| 60-48251 | 3/1985 | Japan . |
| 60-143620 | 7/1985 | Japan . |
| 62-102968 | 5/1987 | Japan . |
| 62-37525 | 8/1987 | Japan . |
| 63-7264 | 1/1988 | Japan . |
| 63-312809 | 12/1988 | Japan . |
| 1-177967 | 7/1989 | Japan . |
| 1-234157 | 9/1989 | Japan . |
| 1-234158 | 9/1989 | Japan . |
| 2-9566 | 1/1990 | Japan . |
| 3-22884 | 5/1991 | Japan . |
| 3-22883 | 5/1991 | Japan . |
| 4-26762 | 5/1992 | Japan . |

*Primary Examiner*—Marvin M. Lateef
*Attorney, Agent, or Firm*—Knobbe, Martens, Olson & Bear

[57] ABSTRACT

A chip varistor formed of a single layer varistor element includes a pair of non-ohmic contact electrodes and a pair of ohmic contact electrodes. The varistor element is a rectangular shape having top and bottom surfaces, two opposite edges and two opposite ends. Each of the non-ohmic contact electrodes covers one of the opposite ends of the varistor element and extends over a majority portion of either one of the top or bottom surfaces. Each of the ohmic contact electrodes is arranged at the center of corresponding one of the top and bottom surfaces of the varistor element. The ohmic contact electrodes directly contact the surfaces of the varistor element to form a ohmic contact relative to the varistor element. Each of the pair of non-ohmic contact electrode is electrically connected to each of the pair of ohmic-contact electrodes while forming a non-ohmic contact with respect to the varistor element.

3 Claims, 4 Drawing Sheets

CHIP VARISTOR

BACKGROUND OF THE INVENTION

1. Field of the Invention

This invention relates to a chip varistor and its production method and is particularly directed to a chip varistor and its production method having an improved structure of electrodes so as to obtain high surge current endurance.

2. Description of the Prior Art

An increase in the amount of varistors, which are non-linear resistance elements, currently in use corresponds to the increased use of electric machines and devices in recent years. In addition, chip varistors are increasingly needed due to miniaturization of devices.

An important feature of chip varistors is surge current endurance. In use, chip varistors protect against both large and small current surges. Therefore, chip varistors are critical components with respect to product reliability and durability.

FIG. 1 shows a cross sectional view of a conventional chip varistor 20.

The chip varistor 20 is comprised of: a rectangular-parallelepiped shaped varistor element 21 which is mainly made of zinc oxide (ZnO); and, electrodes 22*a*, 22*b* made of a material in which boro-silicated glass frit is added to, for example, silver. The electrodes 22*a*, 22*b* are in contact with the varistor element 21. One electrode extends from one opposing surface to one end of the varistor element 21 and the other electrode extends from the other opposing surface to the other end of the varistor element 21.

Application of a certain voltage to the pair of electrodes 22*a*, 22*b* and a large amount of current to the varistor element 21 causes an intensified concentration of electric current at ends of the electrodes 22*a*, 22*b*. This intensified concentration of electric current is indicated by the arrows shown in FIG. 2. In addition, the sections of the varistor element 21 proximate to the ends of the electrodes 22*a*, 22*b* are also damaged, as a result of the above mentioned condition. Thus, the surge current endurance of the varistor 21 is decreased.

Furthermore, gap intervals "b" between the electrodes must be larger than the thickness "a" of the varistor element, as shown in FIG. 3. Therefore, this creates a dimensional limitation in producing electric poles.

Hence, it is an object of the present invention to provide a new chip varistor which has a greater surge current endurance than conventional chip varistors, thereby increasing the reliability and durability of devices utilizing the new chip varistor, and an improved method of manufacturing chip varistors.

SUMMARY OF THE INVENTION

The chip varistor of the present invention is comprised of a varistor element and a pair of electrodes accommodated on the outer surfaces of the varistor element. The electrodes are characterized as follows:

- a pair of electrodes, comprising a pair of ohmic contact electrodes, is provided on opposing surfaces of the varistor element; and,
- a pair of non-ohmic contact electrodes, respectively connected to the pair of ohmic contact electrodes, is extended to both ends of the varistor element so as to form terminal electrodes.

Due to the particular configuration of the chip varistor, as described above, the application of a large electric current to the varistor element of the chip varistor will not damage the electrodes. The current is dispersed or flows equally through the electrodes and into the varistor element positioned between the pair of ohmic contact electrodes. This results in large endurance against the surge current. In addition, the varistor element is also protected against damage caused by the surge current, thereby improving product reliability and durability.

The present invention also includes a method of producing a chip varistor comprised of a calcined varistor element, having a non-linear voltage characteristic, and a pair of electrodes, accommodated at peripheral surfaces of the varistor element. The production method includes a step for rounding the corners of the varistor element. This is accomplished by dry polishing the corners, utilizing organic abrasives, before the calcination process.

According to the above-described chip varistor production method, since the corners of the varistor element are rounded by the dry polishing method prior to the calcination process, there is no need to round the varistor element after calcination. Further, a decrease in varistor resistance on the surface layer of the varistor element, typically caused by the polishing process following the calcination process, is, subsequently, avoided. Therefore, the true electric characteristics are maintained. In addition, the dry polishing method advantageously creates irregularities on the surface of the varistor element. This prevents the varistor elements from sticking together during the calcination process, thereby resulting in improved production yields.

BRIEF DESCRIPTION OF THE INVENTION

DESCRIPTION OF THE PREFERRED EMBODIMENTS

The preferred embodiment of the present invention is described in detail below.

Figure 1:
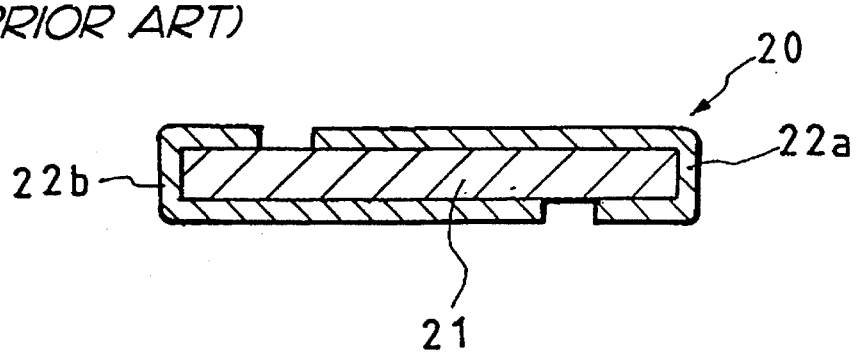
FIG. 1 (PRIOR ART)
FIG. 1 is a cross sectional view showing a conventional chip varistor.
Figure 2:
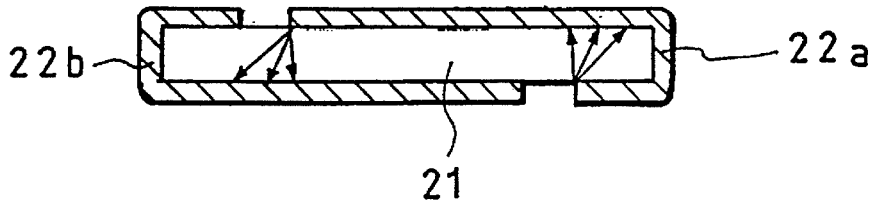
FIG. 2 (PRIOR ART)
FIG. 2 is an explanatory view showing a situation where electric currents are concentrated on the conventional chip varistor.
Figure 3:
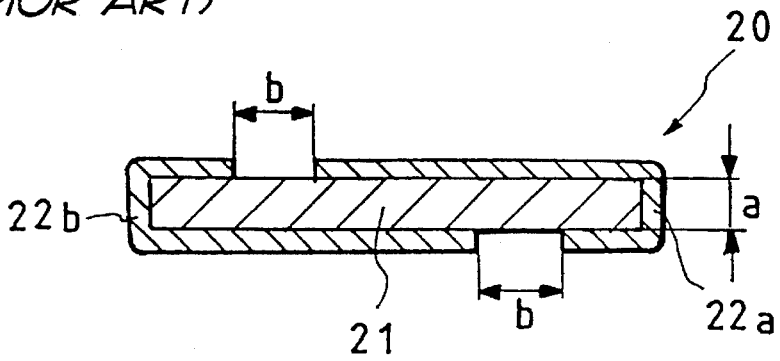
FIG. 3 (PRIOR ART)
FIG. 3 is a cross sectional view showing another embodiment of the conventional chip varistor.
Figure 4:
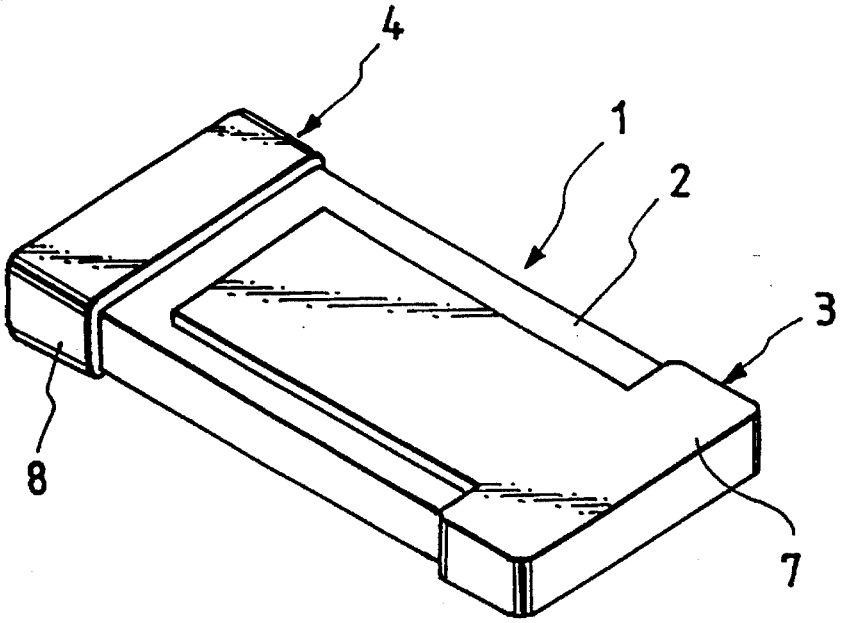
FIG. 4 is a perspective view showing a preferred embodiment of the chip varistor of the present invention.
Figure 5:
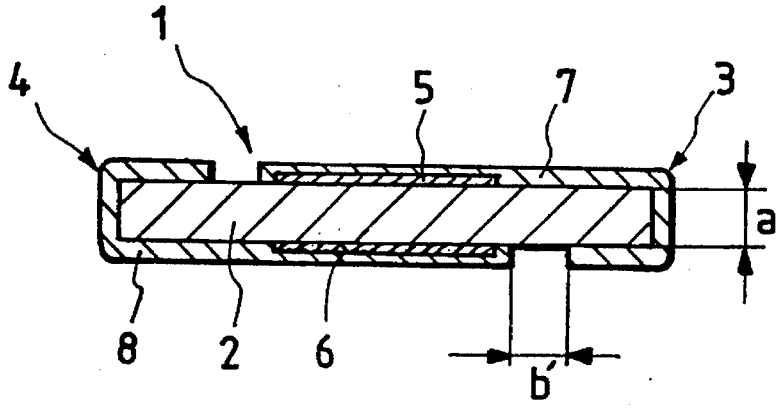
FIG. 5 is a cross sectional view showing the preferred embodiment of the chip varistor of the present invention.

As shown in FIGS. 4 and 5, a chip varistor 1 is comprised of a varistor element 2, which is mainly made of zinc oxide (ZnO), and a pair of electrodes 3, 4, which are accommodated on the periphery of the varistor element 2.

The electrode or electric pole 3 is comprised of an ohmic contact electrode 5 and a non-ohmic contact electrode 7. The ohmic contact electrode 5 is typically positioned at the center of the varistor element 2. The electrode 5 is made of boro-silicated glass frit, or indium (In), or gallium (Ga), or zinc (Zn), or aluminum (Al), and silver or the like (Ag, Zn, Al, Pd, Ag+Pd, or Ag+Pt). The non-ohmic contact electrode 7, which is connected to the ohmic contact electrode 5, extends to the end of the varistor element 2 so as to cover one end or terminal of the varistor element 2. Thus, the non-ohmic contact electrode forms the terminal pole. The non-ohmic contact electrode 7 is made of boro-silicated glass frit and silver or the like (Ag, Al, Pd, Ag+Pd, or Ag+Pt). The boro-silicated glass utilized in this example can be boro-silicated lead glass or boro-silicated lead zinc glass.

The other electrode 4 is comprised of an ohmic contact electrode 6 and a non-ohmic contact electrode 8. The ohmic contact electrode 6 is typically positioned at the center of the varistor element 2, so as to correspond to the ohmic contact electrode 5. The ohmic contact electrode 6 is made of the same materials as the ohmic contact electrode 5. The non-ohmic contact electrode 8, which is connected to the ohmic contact electrode 6, extends to the end of the varistor element 2 so as to cover the other end or terminal of the varistor element 2. The non-ohmic contact electrode 8 is made of the same material as that of the non-ohmic contact electrode 7.

The production method of the chip varistor of the present invention is comprised of the following.

Figure 6:
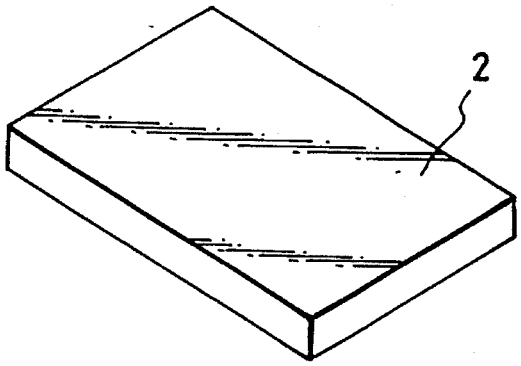
FIG. 6 is a perspective view showing a production method of the chip varistor of the present invention.
Figure 7:
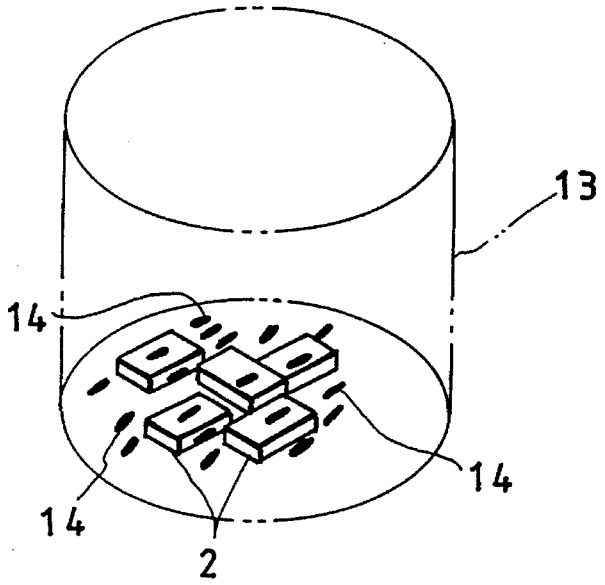
FIG. 7 is another perspective view showing the production method of the chip varistor of the present invention.

First, a plurality of rectangular-parallelepiped-shaped varistor elements 2, mainly made of zinc oxide (ZnO), are placed in a tube-shaped rotatable plastic pot 13, as shown in FIGS. 6 and 7. Next, organic abrasive materials 14 sized between 0.5 and 10 mm, for example, are put into the rotatable pot 13.

The organic abrasive materials 14 are selected from seed rice, walnut shells, cone, or synthetic materials. An advantage of utilizing organic abrasive materials in this process is the elimination of surface cracks on the varistor element.

Next, the tube-like rotatable pot 13 is kept rotating from 5 minutes to 2 days so that the varistor elements 2 are dry-polished therein. The polishing time is set depending on dimensions or volumes of the varistor elements 2.

Figure 8:
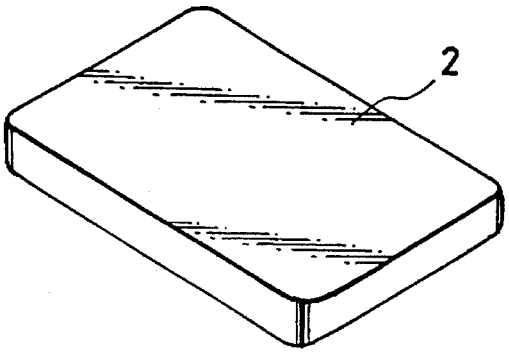
FIG. 8 is a further perspective view showing the production method of the chip varistor of the present invention.

By performing dry polishing, the eight corners and surfaces of the varistor element are rounded, as shown in FIG. 8, and, also, small irregularities are created on the surface of the varistor elements 2.

Finally, the calcination process is performed on the rounded varistor elements 2, utilizing temperatures between 1100°–1400° C., for example. Since irregularities are created on the surfaces of the varistor elements 2 during the dry polishing, the varistor elements do not stick together. Advantageously, fewer scratches are created on the surfaces of the varistor elements, since it is not necessary to separate the varistor elements. In addition, degradation of electrical characteristics caused by the scratches are, subsequently, eliminated. Hence, production proceeds without experiencing many interruptions.

Furthermore, since the varistor elements 2 are first rounded by the dry polishing method utilizing the organic abrasives before the calcination process is started, as stated above, the rounding process is not necessary after the calcination process. Since the varistor element is hardened after the calcination process, performing the rounding process after the calcination process typically produces cracks or scratches on the surface of the varistor element. These cracks or scratches on the varistor surface may cause lattice defects which lower the surface resistance of the varistor element. However, due to the production method of the present invention, fewer scratches are created and, thus, decreases in surface resistance are eliminated. Therefore, the chip varistor 1 achieves the required electric characteristics.

Figure 9:
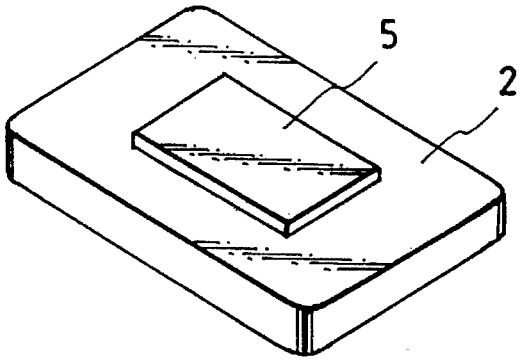
FIG. 9 is a further perspective view showing the production method of the chip varistor of the present invention.

As shown in FIGS. 5 and 9, the ohmic contact electrodes 5 and 6 are positioned on the top and bottom surfaces of the varistor element 2. The electrodes or poles 5 and 6 are made of boro-silicated glass frit, or indium (In), or gallium (Ga), or zinc (Zn), or aluminum (A1), and silver and the like (Ag, Zn, Al, Pd, Ag+Pd, or Ag+Pt). The non-ohmic contact electrodes 7 and 8 are respectively connected to the pair of ohmic contact electrodes 5 and 6. The electrodes 7 and 8 are made of boro-silicated glass frit and silver and the like (Ag, Al, Pd, Ag+Pd, or Ag+Pt). This structure provides the chip varistor, as shown in FIG. 4, where both ends of the varistor element 2 are covered by the non-ohmic contact electrodes 7 and 8.

By structuring the chip varistor 1 in this manner, intensified concentrations of electric currents at the ends of the electrodes 7 and 8 are eliminated. Thus, when a large amount of current is applied to the varistor element 2 through the non-ohmic contact electrodes 7 and 8 and the ohmic contact electrode 5 and 6 by connecting the electrodes 7 and 8 to a power supply, the current flows smoothly through the ohmic contact electrodes 5 and 6 without causing any localized concentration of the current. Therefore, the chip varistor 1 is able to withstand or endure large surge currents. Further, the varistor element is protected against damage resulting from such surge current and, thus, has improved product reliability and durability.

As shown in FIG. 5, a relationship between an interval "b" between the non-ohmic electric poles 7, 8 and a thickness "a" of the varistor element 2 is expressed as follows:

$$a<b'=\{(\text{conventional gap interval } b)-(\text{a distance corresponding to non-ohmic voltage [electric barrier]})\}$$

As a result, the interval "b'" between the non-ohmic contact electrodes 7, 8 is smaller. The value of the conventional gap interval "b" is, for example, 1 mm. The distance corresponding to the non-ohmic voltage in the above relationship usually matches with a diameter of the material used, zinc oxide in this example, and is typically 0.1 mm or less, which is about 10% of the conventional gap length. Thus, the present invention provides less restrictions in determining dimensions when forming the pair of electrodes 3 and 4.

Figure 10:
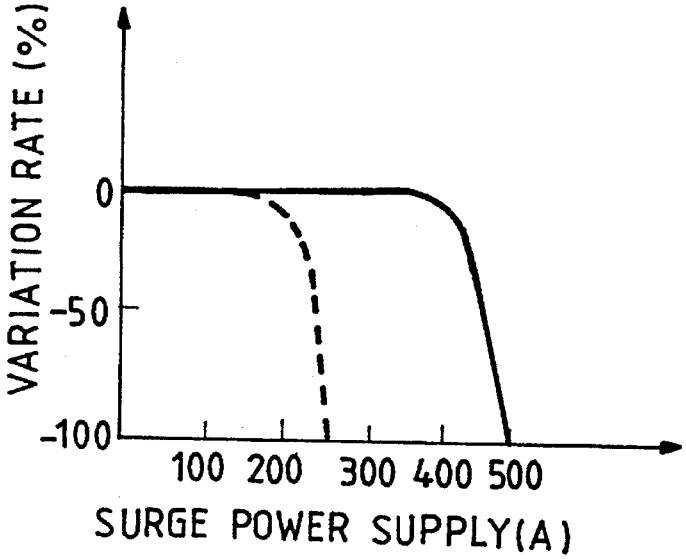
FIG. 10 is a graph showing a relationship between an applied surge current and a variation rate of varistor voltage in the conventional chip varistor.

FIG. 10 shows the relationship between the applied surge current and the variation rate of the varistor voltage for the chip varistor 1 of the present invention and the chip varistor 20 of conventional technology.

As is apparent in the drawing, the varistor characteristic of the chip varistor 20 of conventional technology is significantly deteriorated at around 250A. In contrast, the varistor characteristic of the chip varistor 1 of the present invention deteriorates around 500A. Therefore, the present invention has a surge endurance that is twice as much as that of the conventional chip varistor.

Figure 11:
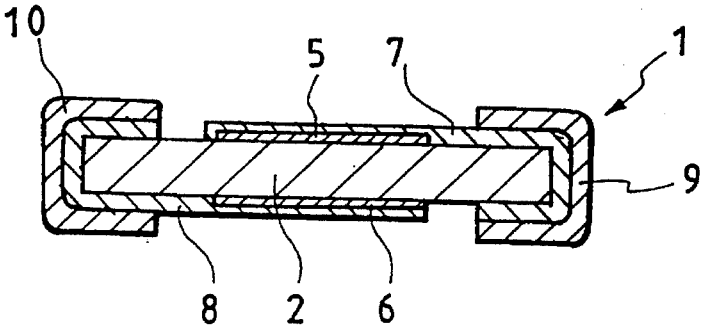
FIG. 11 is a cross sectional view showing another structure of the chip varistor of the present invention.

In addition, as shown in FIG. 11, the present invention also provides a structure wherein additional terminal electrodes poles 9 and 10 may be accommodated at the periphery of the non-ohmic contact electrodes 7 and 8 of the chip varistor 1.

The terminology, "non-ohmic contact", is defined as a contact on an electrode that does not ohmically contact the varistor element. In addition, the electrode does not electrically contact the varistor element. Such an electric isolation is realized, for example, by the diffusion process wherein a material, like natrium (Na), on the surface of the varistor element forms an insulation layer between the electrode and the varistor element.

What is claimed is:

1. A chip varistor comprising:

a varistor element having top and bottom surfaces, opposite sides and opposite ends, said varistor element being a single layer;

a pair of non-ohmic contact electrodes accommodated on said varistor element, one said non-ohmic contact electrodes covering one of said opposite ends of said varistor element and extending over a majority portion of said top surface, and the other nonohmic contact electrode covering other end of said varistor element and extending over a majority portion of said bottom surface;

a pair of ohmic contact electrodes arranged each of which is arranged at a center of corresponding one said top and bottom surfaces of said varistor element, each of said ohmic contact electrodes directly contacting one of said surfaces and forming a ohmic contact relative to said varistor element; and each of said pair of non-ohmic contact electrode being electrically connected to each of said pair of ohmic-contact electrodes while forming a non-ohmic contact with respect to said varistor element.

2. A chip varistor as defined in claim 1, wherein said ohmic contact electrode is made of materials selected from a group consisting of boro-silicated glass frit, In, Ga, Zn or Al and added with materials selected from a group consisting of Ag, Zn, Al, Pd, Ag+Pd, or Ag+Pt.

3. A chip varistor as defined in claim 1, wherein said non-ohmic contact electrode is made of materials selected from a group consisting of Ag, Pd, Ag+Pd, or Ag+Pt and added with boro-silicated glass frit.

* * * * *